US006896581B2

(12) United States Patent
Otto

(10) Patent No.: US 6,896,581 B2
(45) Date of Patent: May 24, 2005

(54) BREAST CUP CONSTRUCTION

(75) Inventor: David William Otto, Auckland (NZ)

(73) Assignee: Featherlift Limited, Auckland (NZ)

( * ) Notice: Subject to any disclaimer, the term of this patent is extended or adjusted under 35 U.S.C. 154(b) by 0 days.

(21) Appl. No.: 10/372,672

(22) Filed: Feb. 25, 2003

(65) Prior Publication Data

US 2003/0224698 A1 Dec. 4, 2003

Related U.S. Application Data

(63) Continuation of application No. PCT/NZ01/00175, filed on Aug. 24, 2001.

(30) Foreign Application Priority Data

Aug. 24, 2000 (NZ) ..... 506550

(51) Int. Cl.[7] ..... A41C 3/00
(52) U.S. Cl. ..... 450/59; 450/64
(58) Field of Search ..... 450/59–61, 1, 450/41–44, 53, 64, 65, 66; 2/106, 105, 73, 243.1, 115, 113, 118, 121, 122

(56) References Cited

U.S. PATENT DOCUMENTS 3,516,415 A * 6/1970 Hadley-Webb ..... 450/65
3,780,741 A 12/1973 Cole
3,834,397 A 9/1974 Birch
4,393,875 A 7/1983 O'Boyle et al.
4,453,549 A * 6/1984 DiTullio ..... 450/74
5,045,019 A 9/1991 Capasso et al.
5,167,566 A * 12/1992 Novitsky et al. ..... 450/74
5,660,577 A * 8/1997 Modena ..... 450/86
5,823,851 A * 10/1998 Dicker ..... 450/2

FOREIGN PATENT DOCUMENTS

AU 59559/69 2/1971
AU 52/483/73 8/1974
EP 0752213 A1 1/1997
EP 0941674 A1 9/1999
WO WO99/53780 10/1999

* cited by examiner

*Primary Examiner*—Gloria M. Hale
(74) *Attorney, Agent, or Firm*—Jacobson Holman PLLC

(57) ABSTRACT

Hands Free Breast Pump Bra comprises a side bra opening with circular opening at the center for easy inserting and securing the suction cup in place while also supporting a woman's breast. A bra comprises cotton, elastic cloth, and nylon with or without underwire. The Hands Free Breast Pump Bra is designed to provide a hands free experience for nursing mothers to perform other tasks while using a breast pump device. This is a special time in a woman's life and it will be important to have a comfortable nursing bra. As a result, there exists a need for a hands free breast pump bra that will make life easier for the nursing mother while expressing milk for her newborn. Furthermore, there exists a need for such bra that is washable, practical, which can be worn outside the home with an areola cup, convenient for pumping when needed.

3 Claims, 7 Drawing Sheets

BREAST CUP CONSTRUCTION

This is a continuation of PCT/NZ01/00175 filed Aug. 24, 2001 and published in English.

TECHNICAL FIELD

The present invention relates to breast cup construction. In particular although not solely it relates to breast cup construction for garments such as a brassiere.

BACKGROUND ART

Numerous designs of brassiere exist. Designers over the years have also paid significant attention to the shape of the breast cup of brassieres.

Changing fashion trends and new materials have over the last one hundred years, seen significant changes and advancements in brassiere design where focus has been on numerous important factors such as comfort, shape, shape enhancement, stability and general aesthetics, and manufacturing benefits.

Brassieres which are designed to enhance the bust line or cleavage of the wearer of the bra have also come in many different shapes and designs. By way of example U.S. Pat. No. 3,834,397 discloses a brassiere where the cup construction is provided with padding to force upwardly, the lower regions of the breast.

Breast cup constructions also vary. By way of example, U.S. Pat. No. 3,780,741 illustrates the construction of a breast cup wherein two panels are provided to define the breast cup and which have been sewn together in a manner to define a curved seam joining the two panels together and thereby defining a breast cup construction of a specific volume and shape.

Furthermore, and sometimes in addition with the inclusion of padding in a bra, many bras for the enhancement of the bust line, will include an underwire. This underwire normally runs from or approximately to the point where the shoulder straps of a bra connect to each of the cups, and runs around the outer and lower perimeter of the cups. Half cup underwire brasseries are also known, where the underwire extends only along a portion of the outer perimeter of the brasserie.

The provision of an underwire, leads to problems in terms of comfort to the wearer and can also add to the cost of manufacture. They can also be easily damaged when being washed and machine dried.

Accordingly it is an object of the present invention to provide a breast cup construction without an under wire or padding, which enhances the bust line of the wearer of the garment which incorporates such a breast cup construction.

It is also an object of the present invention to provide a brassiere construction which enhances the bust line of the wearer without the need to use underwire or padding techniques.

It is also an object of the present invention to provide a breast cup construction and garment incorporating such which will at least provide the public with a useful choice.

SUMMARY OF THE INVENTION

Accordingly the present invention may broadly be said to consist in a breast cup construction comprising a lower most cup panel of a flexible material having an upper joining edge of a predetermined curvature, and an intermediate cup panel of a flexible material having a upper joining edge of a predetermined curvature, and a lower joining edge secured to said upper joining edge of said lower most cup panel, and an upper cup panel of a flexible material having a lower joining edge secured to said upper joining edge of said intermediate cup panel, wherein said lower joining edge of said intermediate panel is of a length to be co-terminus with the upper joining edge of said lower most panel, and wherein said lower joining edge of said upper panel is of a length to be co-terminus with the upper joining edge of said intermediate panel, and wherein said predefined 3:0 cup shape formed by said panels and the seams of said joining edges, includes an inner region and outer perimeter line wherein the seam of said joining edges of said lower panel with said intermediate panel starts as a first point at the inner region of said cup and extends to the other distal end provided at said outer perimeter line of said cup without said seam dipping significantly vertically below said first point, and wherein the seam of said joining edges of said intermediate panel with said upper panel starts at or proximate to said first point at said inner region of said cup and extends to its other distal end provided at the outer region of said cup, vertically higher than said first point.

Preferably said outer most perimeter line is a curve which has an upper terminus at the upper most point of said cup form, and an inner terminus at the inner region of said three dimensional cup form, and extends from its upper terminus downwardly, and extends from said inner terminus, outwardly.

Preferably said downward curve of said outer perimeter line from said upper terminus also includes a component of direction which is outwardly (i.e. away from said inner region).

Preferably said outwardly extending direction of said outer perimeter line from said inner region, also includes a component of direction which is downwardly.

Preferably said seams of both said joining edges of said intermediate panel are co-terminus at the inner region.

Preferably said outer perimeter line is co-terminus with said seams of both said joining edges of said intermediate panel at said inner region.

Preferably said seam of said joining edges of said lower panel with said intermediate panel has its first point and said outer distal end in substantial horizontal alignment.

Alternatively said other distal end of said joining edges of-said intermediate panel with said lower panel, is slightly higher but no higher than 20° above the horizontal, from said first point of said seam.

Preferably said other distal end of said seam of said joining edge of said intermediate panel with said upper panel is at or towards the upper most point of the outer perimeter line of said cup.

Preferably said other distal end of said seam of said joining edges of said intermediate panel with said upper panel at said outer is substantially at an angle of between 40° and 50° and preferably at 45° above the horizontal from the first point.

Preferably the curvature of said seam of said joining edges of said intermediate panel with said upper panel dips below said 45° angle.

Preferably the other distal ends of said seam of said joining edges of said intermediate panel with said upper panel, and the upper edge of said upper panel, are co-terminus.

In a second aspect the present invention broadly consists in an article of clothing which includes a breast cup construction as hereinbefore described.

In a further aspect the present invention broadly consists in a brassiere which includes a breast cup construction as hereinbefore described.

In a further aspect the present invention consists in an article of clothing which is a brassiere or includes a brassiere and comprises two breast receivable cups located on either side of an inner region of said brasserie, each cup connected to a shoulder engageable strap connected to an upper region side panels extending, and connected to an outer perimeter line of each said cup for engagement about the chest of the wearer of the brassiere, said cup comprising at least three panels which include, a lower most panel having an upper edge of a predetermined curvature, an intermediate panel having a lower edge secured to the upper edge of said lower most panel, and having an upper edge of a predetermined curvature, and an upper panel having a lower edge secured to the upper edge of said intermediate panel and having an upper edge, wherein said lower edge of said lower most panel is secured to a portion of the outer edge of said cup from a region extending substantially at the inner most edge to a point coinciding with the terminus of the upper edge of said lower most panel away from said inner edge, at a point higher than the lower most region of said outer edge, and wherein the outer terminus of this upper edge seam of the intermediate panel with the lower edge seam of the upper panel is at approximately upper most region of the outer edge of said cup which is vertically higher than the inner most terminus of the said seam which is at or towards the inner region of said cup.

Preferably said upper panel is the upper most panel.

Alternatively said upper panel has an upper most panel secured to the upper edge thereof.

Preferably said upper most panel is moveable between an extended condition and a folded condition wherein in the folded condition it is folded an tucked into the cup region.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the present invention will now be described with reference to the accompanying drawings in which.

DETAILED DESCRIPTION OF THE PREFERRED EMBODIMENTS

Figure 1:
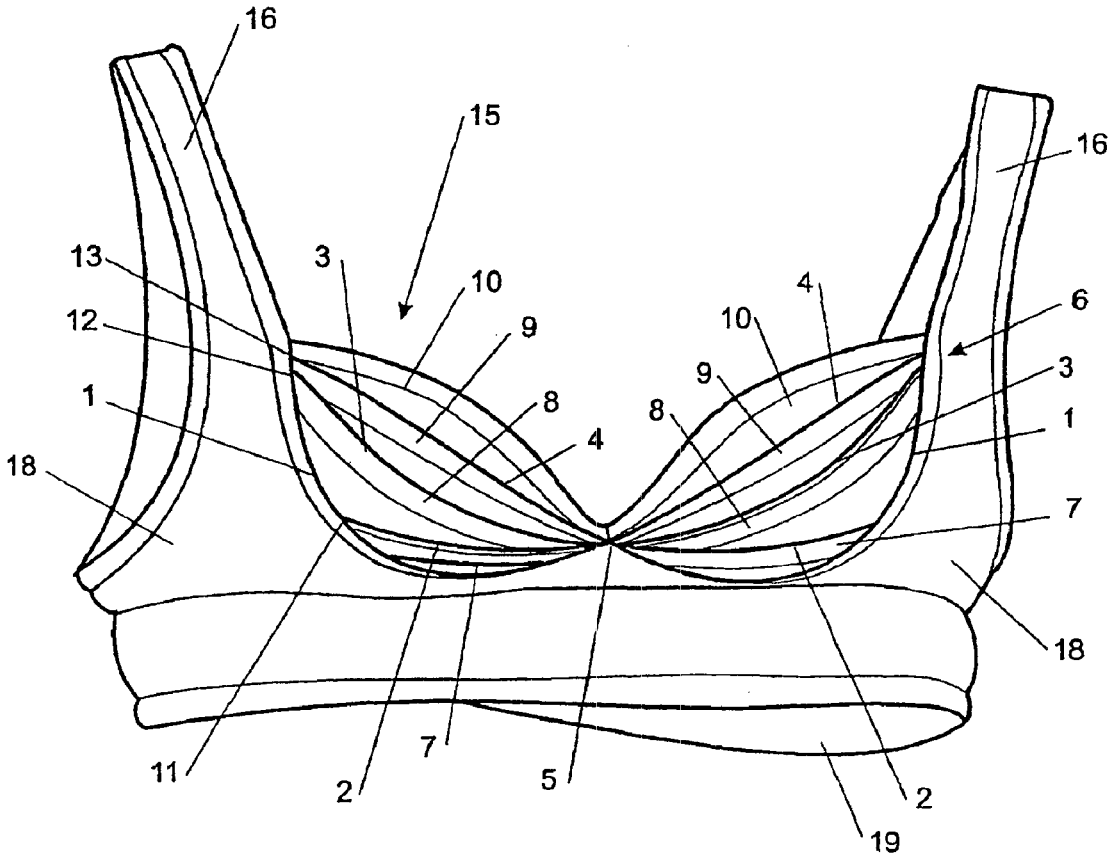
FIG. 1 is a view of a brassiere with incorporates the breast cup construction of the present invention.
Figure 2:
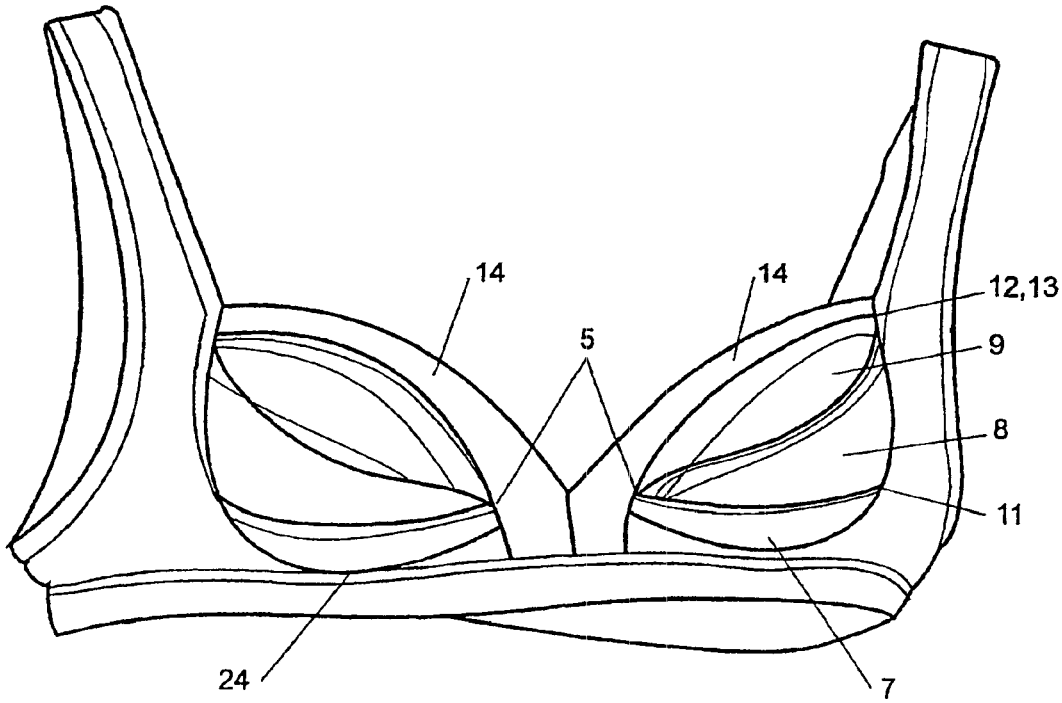
FIG. 2 is an alternative construction of a brassiere which incorporates the breast cup construction of the present invention.
Figure 6:
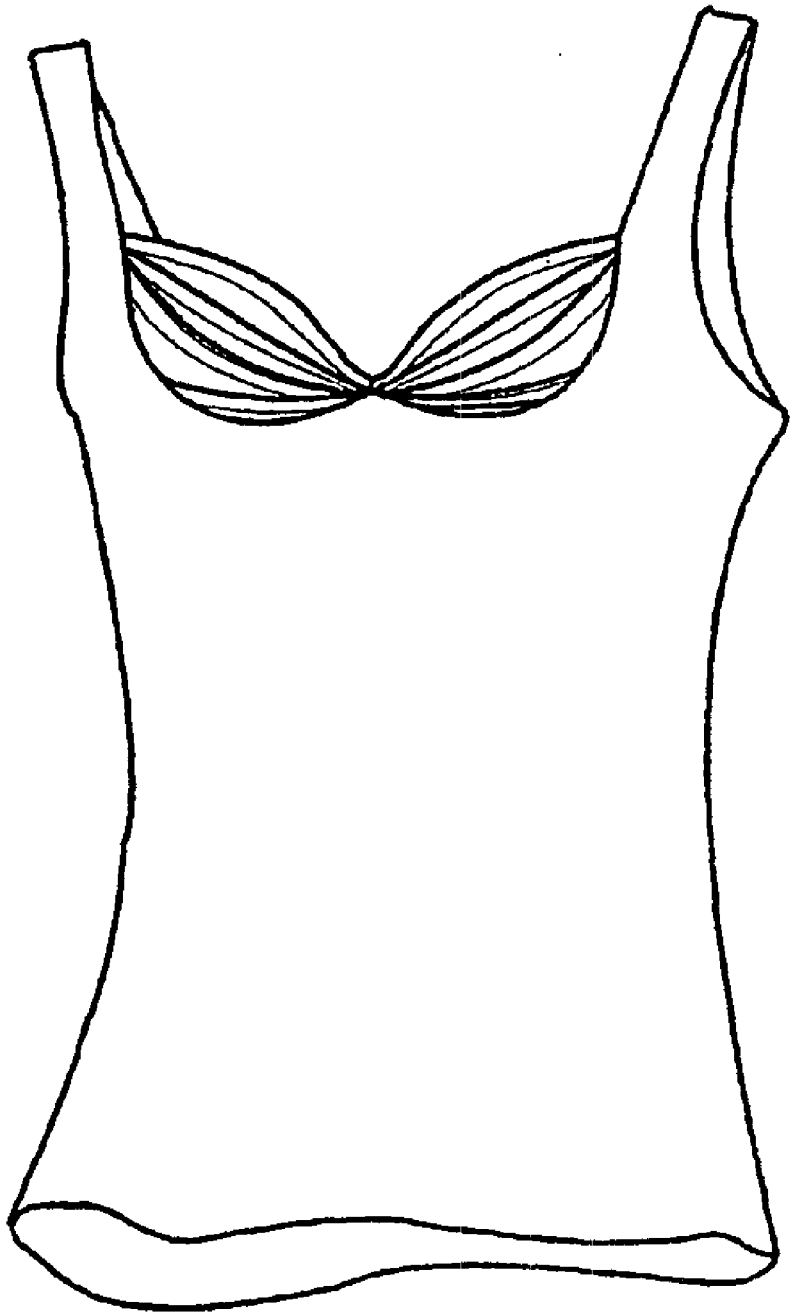
FIG. 6 illustrates the breast cup construction of the present invention incorporated in a garment other than brassiere and FIG. 7 illustrates the forces and angles of the forces acting on the lines and seams of the breast cup construction.

With reference to FIGS. 1 and 2, the present invention incorporates a breast cup construction in a garment such as, for example, a brassiere or bikini top or the like. The present invention however can also be incorporated in other garments such as in a dress (as per for example FIG. 6) or the like. The breast cup construction avoids the need for the use of an underwire or padding in the cup as a result of the manner in which the at least three regions preferably defined by panels 7, 8, 9 or the breast cup construction are provided.

Whilst hereinafter, our focus on the description is in relation to brassieres incorporating the breast cup construction of the present invention, it is to be appreciated that it is not limited to brassieres only.

In a first preferred construction of the cup as defined in the figures, the brassiere includes the breast cup construction 15 as appropriately incorporated in a support providing structure. The support providing structure provides shoulder engaging straps 16 and side panels 18 extending to a strap 19 to locate around the chest of the wearer.

Each of the two cups of the brassiere as shown in FIG. 1 includes an outer most edge 1 and an inner most region 5. In FIG. 1, the inner most region 5 of each of the two cups of the brassiere coincide. In FIG. 2 the inner most region of each cup construction are separated by an optional band 14.

Each cup has at least three panels, a lower most panel 7, an intermediate panel 8 and an upper panel 9. The upper panel 9 may be the uppermost panel or may have thereabove a further upper or uppermost panel 10. This panel 10, (or 14) is optional.

Figure 3:
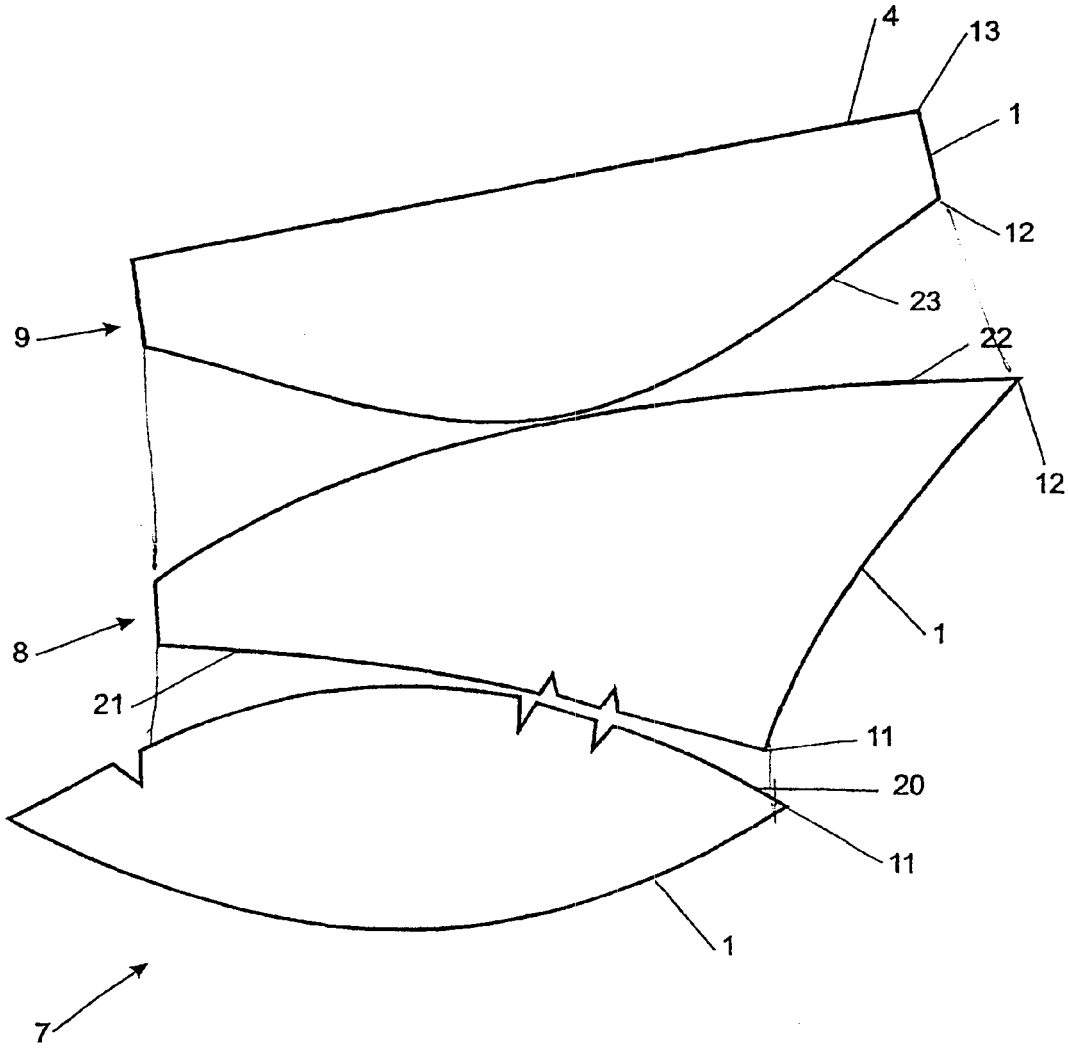
FIG. 3 illustrates in a lay flat condition and prior to being joined together, the first, second and third panels of the breast cup construction of the present invention.

The lower most panel 7 has an upper joining edge 20 of a predetermined curvature. With reference to, for example, FIG. 3 which shows each of the three panels in a lay flat condition, this upper joining edge 20 of the lower most panel 7 is curved. The intermediate panel 8 has a lower joining edge 21 which is also of a predetermined curvature and is secured to the upper edge of the lower most panel 7 to define a seam 2 as shown in FIG. 1.

The intermediate panel has an upper joining edge 22 of a predetermined curvature which is secured to a lower joining edge 23 of the upper panel 9 to define a seam 3. Each of the joining edges of the lower intermediate and upper panels are of a substantially similar length to the edge to which it is joined of the adjacent panel(s). This is not necessarily the case when the panels are in a lay-flat condition and indeed in FIG. 3 the upper and lower edges of each panel are not of the same length.

In the most preferred form each of the seams 2 and 3 (and preferably also seam 4 in the option where a uppermost panel 10 is provided as per FIG. 1) has the inner most terminus preferably at the inner most region 5 of the cup preferably they are co-terminus. The outer terminus of each of the seams 2 and 3, are at the outer edge 1, of the cup and are at different locations. The outer edge 1 is preferably of a smooth and continuous curve and extends from its inner region 5 to an upper most region 6 of the outer edge 1 at the point where or proximate to the point where the shoulder strap is to engage with the cup.

Figure 4:
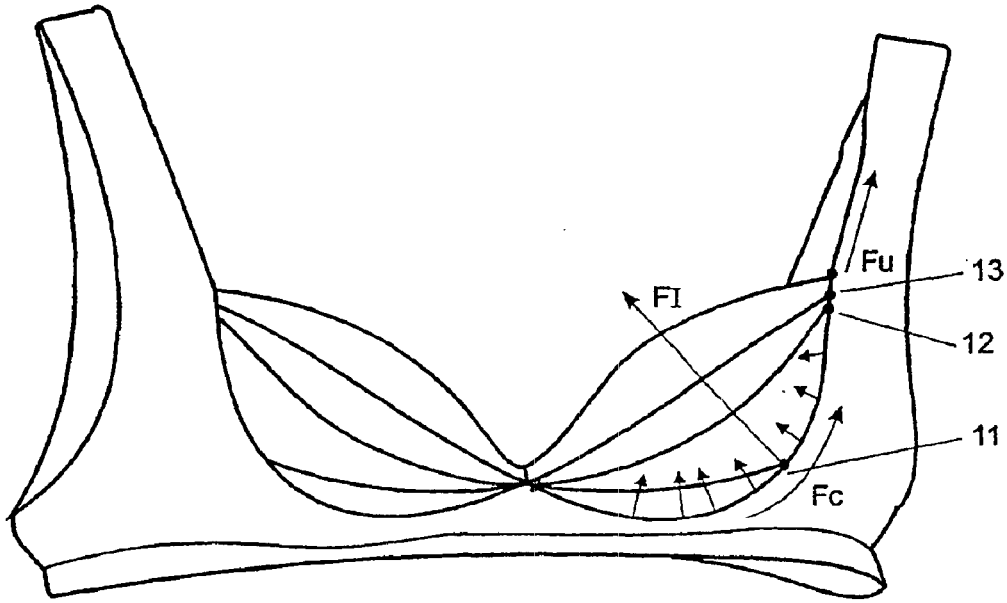
FIG. 4 illustrates a perspective view of a brassiere incorporating the breast cup construction of the present invention, and illustrates the general direction of the various forces that are present in the construction for the enhancement of the bust line.
Figure 5:
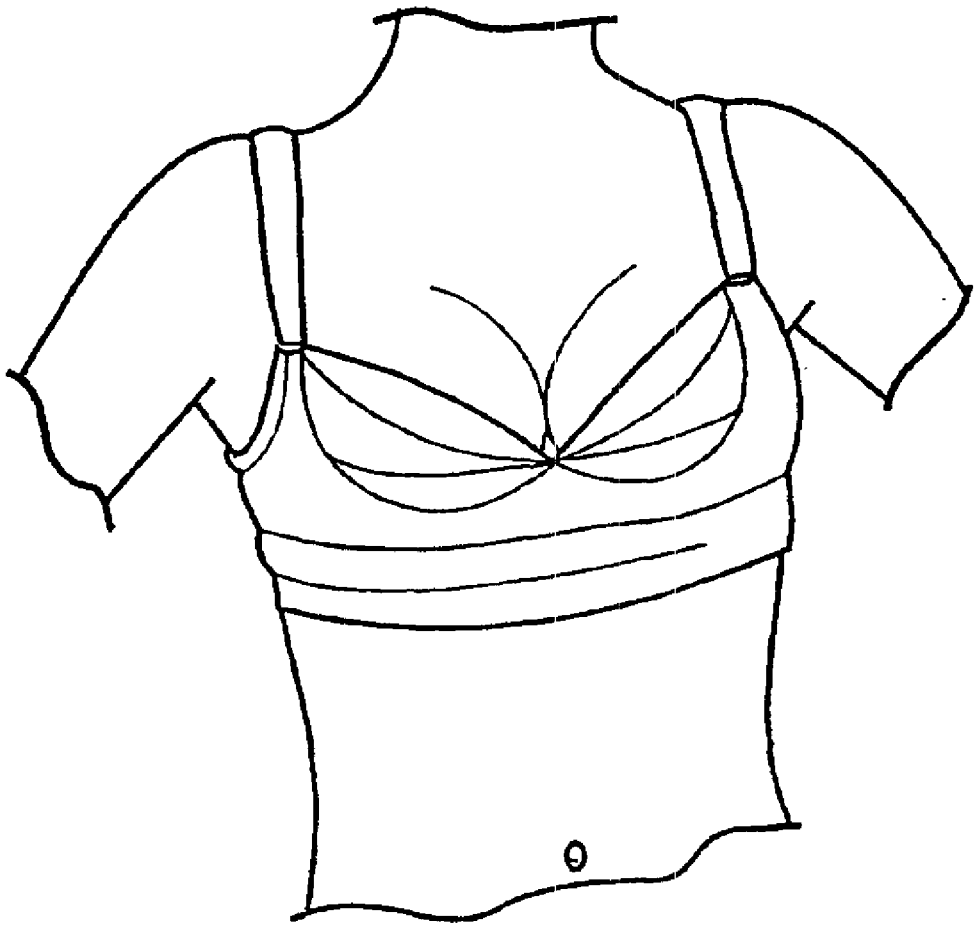
FIG. 5 illustrates one example of a brassiere which incorporates the breast cup constructions of the present invention, in use, where the optional upper most panel is not present or is folded back.

In the form as shown in FIGS. 1 and 2, the outer most terminus 11 of the seam 2 of between the lower and intermediate panels 7, 8 is substantially horizontally in line with its inner most terminus. The outer most terminus is, broadly speaking, provided in a region of the outer most edge 1, where the curvature of the outer most edge 1, running from the top part of the upper most edge towards the inner most region 5, is back towards the inner most region 5. A force $F_I$ (with reference to FIG. 4) which is lateral to the force $F_c$ to the curvature of the outer most edge at point 11 is inwards and upwards, which is the desired direction of pressure applied to the breast. The support and application of the force along the outer perimeter is provided at the top of the outer perimeter line to which the shoulder strap is attached. A distributive force illustrated by the plurality of arrows in FIG. 4 extending from the outer perimeter line is also resultant on the breast cup construction. Because of the outline of the perimeter, the net force as a result of the distributive is both upwardly and inwardly thereby enhancing cleavage.

Figure 7:
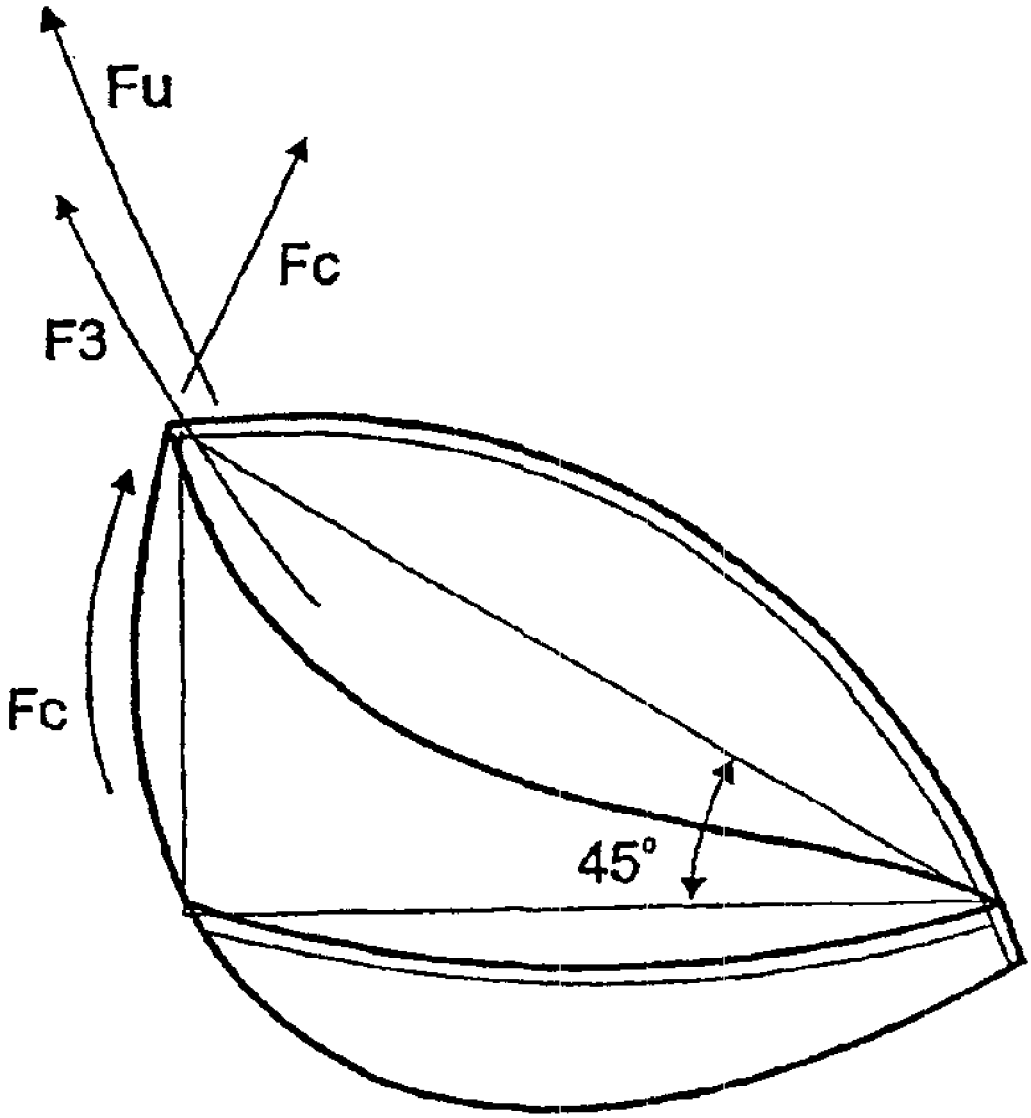

The outer most terminus 12 of the seam 3 joining the intermediate and upper panels 8, 9, is at or towards the upper most point 6 of the outer edge 1 of the cup. This is at or approximate to where the shoulder strap 16 engages with the cup of the brassiere of FIG. 1. The force of the support provided by the shoulder strap is in a generally upward direction as indicated by arrow $F_u$. At the point where the terminus 12, 13 are located, the curvature of the outer edge 1 is, with respect to the vertical, either substantially vertical or in a direction towards or away from the inner most region 5. The force $F_c$ at the terminus 12, is hence at least upwardly but preferably also inwardly. Such an inward angling of the outer edge hence assists the displacement of the breast at this region inwardly hence increasing the bust. An outward angling would reduce the projection of the bust. FIG. 7 clearly illustrates the curvature of the outer edge, with respect to the vertical. With reference to FIG. 7, because of the force $F_c$ applied along the outward edge 1 the resultant force $F_c$ on the terminus 12 also has an inward component encouraging the movement of the bust line both upward and inwardly.

The outer terminus 12 of the scam 3 is vertically higher than its inner terminus. The lower most panel 7 is joined to the structure providing means 18 at the outer most edge 1 of the cup to extend across the lower most point 24 of the outer edge 1. However the lower most point of the outer edge 1 is slightly but not significantly lower than the inner most region 5 of the cup.

The outer edge 1 of the cup, is shaped to have curvature so that when the shoulder strap is tightened by adjustment, the bust moves across and upwards, generally in direction F, to the desired condition. The seam 2, apart from strengthening the cup structure, when the bust moves in its upward position also helps to support the lower area of the bust. The seam 3 forms the shaped area of the cup with seam 2 contributing to the cup contour, and support. The underarm side support 18, 19 can be either a broad band, or straps that may have adjustment to a comfortable position. The unique formation of the invention provides the visual appearance that there is an increase in breast size. It was further realised that as the bust tends to move to the side by its own weight, that the construction of the cup should be based on the side contour of the bust. To obtain a greater bust exposure the optional panel 10 may be folded back about seam 4. To provide the function of a sports bra to cater for larger busted women who do not want emphasis on cleavage, the upper most panel 14 can be changed by bringing it down through the front of the bra. This provides a visually attractive and comfortable bust support enabling the larger busted women, to engage in sports or other activities, or the like. The cup formation would also be suitable for the smaller or medium busted woman who did not want emphasis on cleavage.

When a grading of a larger cup size is necessary it will mean a scaling of the cup size, however the pressure points remain the same in proportion, and the seams 2 and 3 are preferably still interconnected at the inner region of cup. Therefore regardless of cup size the fundamental principals of the invention remain constant. The end result of the invention is to produce a more natural rounded cleavage that is not obtained with others on the market including padded bras that require an artificially enhancement to obtain cleavage.

When the bust is placed in the cup it is displaced inwards and upwards by seam 3 which has its inner and outer terminus preferably set at 45° to the horizontal. Seam 1 has a resultant force, due to the outer seam control at point 11 that lifts at least that end of the seam 2 up and across. This moves the bust upwards and across producing the unique end result of our invention as a naturally rounded cleavage. Seam 1 on its own will not produce the same effect, unless it acts in conjunction with seam 2.

The resultant shape of seam 2 as a factor of the curvature of the joining edges 20, 21 is such that there is a reduction in volume provided in the lower region of the cup, which forces the breast tissue upwards.

The seams of the present invention are preferably seams that are sewn, to define the join between adjacent panels. The material that is used for the cup construction is preferably a flexible fabric. In order to further enhance the effect of the breast cup construction, the seams are preferably of a nature which defines a raised ridge on the interior of the cup. The sewn seams are therefore of a kind which provide this enhancement of a ridge which improves the contact and therefore the transfer of retaining and displacing force onto a breast. Since the panels of the fabric are of a flexible and for example an elastic material the seams provide lines of rigidity which at least along the direction of the seams, the material becomes substantially non extendable. The seams hence define at least some structural rigidity to the three dimensional form of the cup and thereby and in particular as a result of their placement, can provide a reactive force against the outward pressure of the breast to thereby force the breast in those particular areas back towards the body of the person and simultaneously project the breast upwardly and inwardly to provide cleavage. The lower most panel can be shaped so as to reduce the volume of the cup at its lower regions to thereby displace breast tissue towards higher regions of the cup volume. The seam between the intermediate panel and the upper panel may provide a similar effect and because of its angling at preferably 45° it also assists in the displacement of the breast inwardly.

In a second embodiment of the present invention, it is envisaged by the inventor that a breast cup construction may be provided by at least one panel which has been moulded to a 3-D cup shape. To provide structural strength to a moulded panel of flexible material the at least one panel is provided with lines of stitching provided in accordance to what has hereinbefore been described with reference to the seams in the first preferred form of the present invention wherein the cup construction is made from at least three panels. The lines of stitching in a moulded version of the breast cup construction of the present invention hence provide the structural rigidity to the breast cup construction in those regions where it is desired in order to provide the effect of enhanced cleavage. Where the breast cup construction in the second preferred form of the invention is provided by a single panel a first and second line of stitching may be provided wherein the first line extends between the lower and intermediate region (synonymous with the lower and intermediate panel) and the second line of stitching extends between the intermediate and upper region (synonymous with the intermediate and upper panel as previously defined).

It is envisaged that alternative ways of forms the seams may be provided. The material that is used may be of a plastics kind wherein heat welding or the like may be provided for joining the seams. Alternatively adhesion may also prove successful.

The lower waist panel is of an elongate shape and extends in a generally horizontal direction.

The intermediate panel is preferably triangular in shape and its upper edge is concave whilst its other two edges are convex in curvature.

The outer perimeter of the cup construction is curvilinear and preferably substantially convex. It extends from an inner region between said two cups of a brassiere to an upper region where or from which or proximate to which the shoulder straps will attach.

What is claimed is:

1. A breast cup for a brassiere of a predefined three dimensional cup shape and defined by at least one panel of a flexible material defining a perimeter to said breast cup which consists of a neckline perimeter and a continuous lower/outer perimeter line of a curved shape coterminous at a breast cup, and at a second point where said breast cup will affix to a shoulder strap, said breast cup comprising a lower most cup region and an intermediate cup region and an upper cup region defined by said at least one panel, said lower most cup region juxtaposed to said intermediate cup region and said intermediate cup region also juxtaposed to said upper cup region, a first line of stitching extends between said lower most and said intermediate cup regions and a second line of stitching extends between said intermediate cup region and said upper cup regions, the first line of stitching starts at a first point at the first junction of said neckline perimeter and said lower/outer perimeter line of said cup and extends horizontally away therefrom to provide a distal end thereof at said lower/outer perimeter line of said first cup without said line of stitching dipping vertically below said first point, the second line of stitching starts at or proximate to said first point of said first line of stitching and extends away therefrom to provide a distal end thereof at the second junction of said neckline perimeter and lower/outer perimeter line.

2. The breast cup as claimed in claim 1, wherein said at least one panel is moulded to define said three dimensional shape.

3. The breast cup construction as claimed in claim 1, wherein each said at least one panel is defined by separate panels and each said panel of is attached to each other along said lines stitching.

* * * * *